US010113272B2

(12) United States Patent
Boulesteix

(10) Patent No.: US 10,113,272 B2
(45) Date of Patent: Oct. 30, 2018

(54) FISHPLATE COMPRISING A PROTECTIVE STRIP

(71) Applicant: PLASTIFORM'S, Magnac-bourg (FR)

(72) Inventor: Patrice Boulesteix, Limoges (FR)

(73) Assignee: PLASTIFORM'S, Magnac-Bourg (FR)

( * ) Notice: Subject to any disclaimer, the term of this patent is extended or adjusted under 35 U.S.C. 154(b) by 84 days.

(21) Appl. No.: 15/121,526

(22) PCT Filed: Feb. 26, 2015

(86) PCT No.: PCT/FR2015/050459
§ 371 (c)(1),
(2) Date: Aug. 25, 2016

(87) PCT Pub. No.: WO2015/132507
PCT Pub. Date: Sep. 11, 2015

(65) Prior Publication Data

US 2016/0362846 A1 Dec. 15, 2016

(30) Foreign Application Priority Data

Mar. 6, 2014 (FR) ..... 14 51821

(51) Int. Cl.
*E01B 21/02* (2006.01)
*E01B 19/00* (2006.01)
*E01B 21/00* (2006.01)

(52) U.S. Cl.
CPC ..... *E01B 21/02* (2013.01); *E01B 19/003* (2013.01); *E01B 21/00* (2013.01); *E01B 2204/11* (2013.01)

(58) Field of Classification Search
CPC ..... E01B 19/00; E01B 19/003; E01B 21/00; E01B 21/02; E01B 2204/11
See application file for complete search history.

(56) References Cited

U.S. PATENT DOCUMENTS 6,471,138 B1 * 10/2002 Blank ..... E01B 9/62 238/122
7,484,669 B2 * 2/2009 Gray, Jr. ..... E01B 19/003 238/2
8,172,158 B1 * 5/2012 Burkhardt ..... E01B 19/003 238/2
8,985,476 B1 * 3/2015 O'Connell ..... E01B 21/00 238/8
2003/0168519 A1 * 9/2003 Hofstetter, Sr. ..... E01B 19/003 238/8
2005/0023366 A1 * 2/2005 Williams ..... E01B 19/003 238/264
2015/0376842 A1 * 12/2015 Ellis ..... E01B 5/08 238/130

(Continued)

FOREIGN PATENT DOCUMENTS

EP 1 331 310 A2 7/2003
FR 2 885 372 A1 11/2006

(Continued)

OTHER PUBLICATIONS

International Search Report, dated Jun. 11, 2015, from corresponding PCT application.

*Primary Examiner* — Jason C Smith
(74) *Attorney, Agent, or Firm* — Young & Thompson

(57) ABSTRACT

Lateral fishplate (21) for isolating a railway rail, notably a buried rail, the upper face of which includes a protective strip (26).

19 Claims, 2 Drawing Sheets

(56) References Cited

U.S. PATENT DOCUMENTS

2016/0362846 A1* 12/2016 Boulesteix ..... E01B 19/003

FOREIGN PATENT DOCUMENTS

| | | | | |
|---|---|---|---|---|
| FR | 2 947 285 | A1 | 12/2010 | |
| FR | 2 979 643 | A1 | 3/2013 | |
| WO | 01/83889 | A1 | 11/2001 | |
| WO | WO-0183889 | A1 * | 11/2001 | ..... E01B 9/62 |

* cited by examiner

FISHPLATE COMPRISING A PROTECTIVE STRIP

BACKGROUND OF THE INVENTION

Field of the Invention

This invention relates to a device suited for carrying out a seal along a rail buried in a substrate. The invention also relates to a method for implementing such a seal.

For certain vehicles rolling on a rail, in particular tramways, the rails must not form an obstacle for the circulation of pedestrians or automobiles that circulate on the same platform as that used by the vehicle on a rail. This is in particular the case when this platform is a road surface shared by a tram. The rails are then generally provided to be buried in a substrate of this platform, so as to be flush with the platform.

Description of the Related Art

As particularly shown by document FR 2 885 372, the rail is preferably insulated from the substrate by a system of fishplates. The fishplates provide in particular sound insulation, electrical insulation and a seal around the rail with respect to its environment. It must however be assured that moisture does not penetrate, or penetrates very little, between a coating of this platform and the rail. The coating is generally an asphalt, also referred to as a bituminous concrete; the coating can also be concrete or cobblestones.

Document FR 2 947 285 proposes to carry out lateral fishplates that can comprise, in particular, an upper scored portion along a line break running through the lateral face, with the strip extending on either side of said line break. Once the coating is installed, the scored section is removed, creating a groove that is filled with a seal poured in-situ, preferably a bi-component polyurethane seal. However, the preparation of the fishplate, the implementation and the supply of such a seal are long and expensive. Furthermore, this seal is set in place when all of the track and road surface work is completed; As such, the fishplate can be subjected for several months and sometimes for several years to inclement weather and road traffic, before the seal is set in place.

BRIEF SUMMARY OF THE INVENTION

The invention has for purpose to propose a rapid and economical device for carrying out a seal between the rail and the coating of the platform.

According to a first object of the invention, such a device is a fishplate device for a rolling stock rail, in particular a tramway rail, constituted by a lateral fishplate of which an upper face comprises a protective strip. The strip is advantageously glued, preferably via welding, on an upper face of a matrix of the fishplate, matrix of which the material can be chosen from a polyethylene foam, a polyurethane foam, a polypropylene foam and a rubber.

The strip is preferably formed of a wire mesh and of a sheet glued to one another, preferably via welding. The sheet can be a sheet made of polyethylene (PE) or polyethylene terephthalate (PET). The wire mesh can be constituted of wires made of polypropylene, polyethylene, glass fibre or polyamide.

Advantageously, the fishplate can comprise one or several chamfers between its upper face and a lateral face provided to come into contact with the rail.

According to another object of the invention, a method for carrying out a seal along a buried rail in a substrate, comprises the following steps:

supplying of a lateral fishplate;

setting up of said fishplate engaged with the rail.

BRIEF DESCRIPTION OF THE DRAWINGS

Advantageously, this method comprises an additional step for the implementing of a seal along the rail, between the strip and the rail, in a groove formed by a chamfer of the fishplate.

Several embodiments of the invention will be described hereinafter, as non-limiting examples, with reference to the annexed drawings wherein.

DETAILED DESCRIPTION OF THE PREFERRED EMBODIMENTS

In the following description and in the attached figures, arbitrarily and for simplification, the rail is assumed to be installed horizontally. The terms "horizontal" and "vertical" refer to such a position. This does not exclude the rail from being able to be installed with a non-zero cant or slope, without leaving the scope of the invention.

Figure 1:
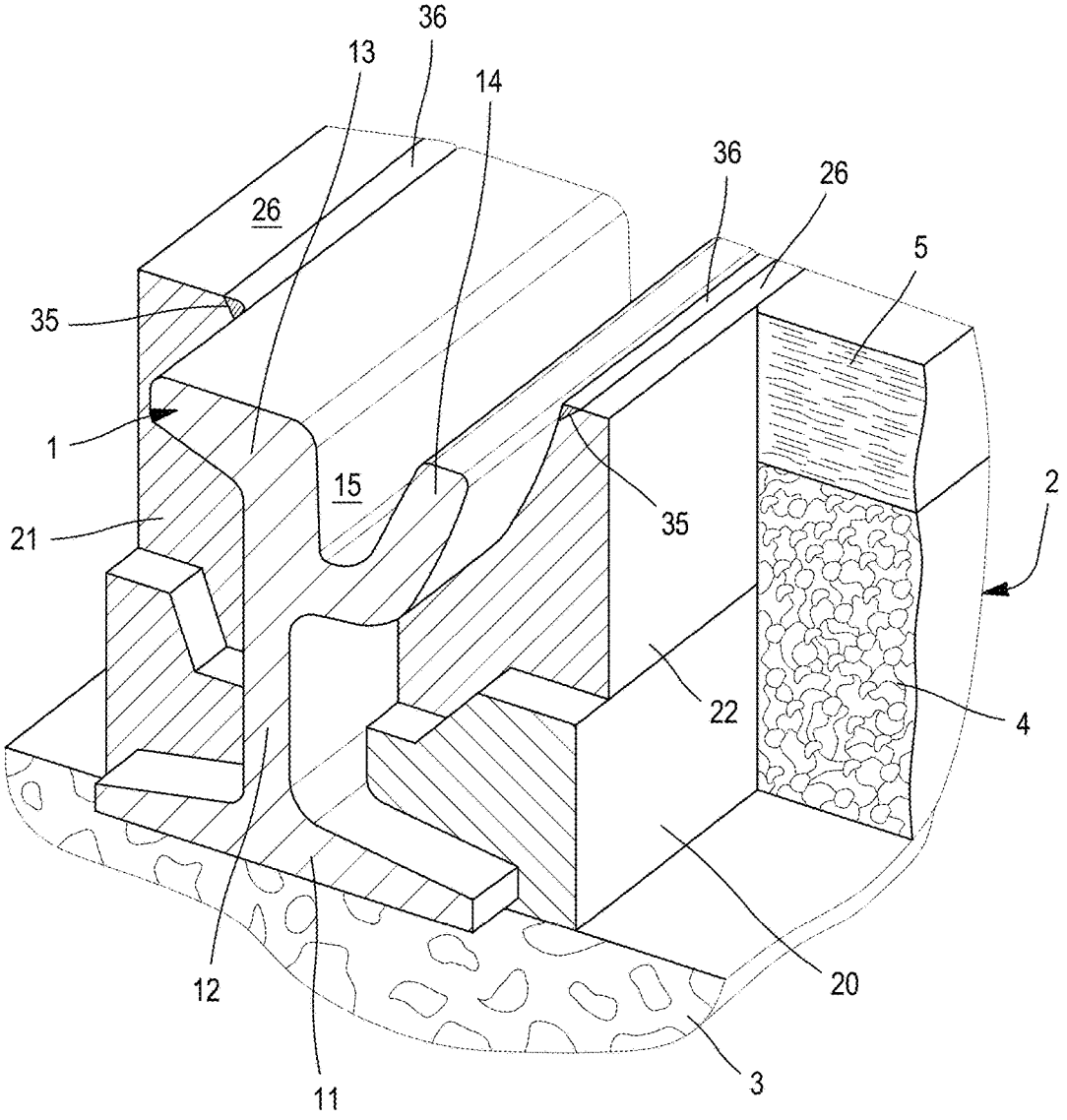
FIG. 1 is a diagrammatical view in perspective and as a cross-section of a tramway rail and of various neighbouring elements provided for the carrying out of a seal according to the invention along the rail.

FIG. 1 shows in perspective and diagrammatically a rail 1 and elements of its environment. The various elements and the rail are shown as a cross-section and offset longitudinally with respect to one another, for an increased legibility of FIG. 1. The rail is shown such as it is provided to be installed buried and flush with a platform 2.

The platform is mainly comprised of three superimposed layers 3-5. A first layer 3, composed of coarse gravel or of concrete, which forms a base of the platform; a second layer 4 composed of fine gravel covers the first layer 3; and, the third layer 5, that covers the second, forms a sealing coating for the platform 2. In the example shown, the third layer 5 is an asphalt.

The rail 1 is a tramway rail of which a running transversal section is in the shape of a Y. It comprises a horizontal shoe 11, a vertical core 12, a rolling portion 13 and a guiding portion 14. The shoe 11 extends symmetrically from the base of the core 12, the rolling and guiding portions extend from an upper portion of the core 12, upwards, in such a way that these portions form between them a groove 15. In their upper portions, the rolling and guiding portions are substantially flush with the platform 2. The rolling portion 13 is provided to serve as a bearing for the wheel tread 18 of a tramway wheel. The groove 15 is provided to receive therein the flank of the wheel and provide the lateral guiding thereof.

In the example shown, the rail is mounted inside fishplates 20-22, a lower fishplate 20 and two lateral fishplates 21, 22. The fishplates are made from a plastic foam, preferably a polyethylene foam. The fishplates are provided to absorb vibrations due to the rolling of the tramways on the rail 1 and prevent the transmission thereof to the near environment, in particular to neighbouring buildings. Furthermore, they must make it possible to ensure a watertight seal between the rail 1 and the rest 3, 4 of the platform in such a way that the rail 1 is protected from stray currents.

The lower fishplate 20 is designed to surround the shoe 11 and the bottom of the core 12. A first lateral fishplate 21 is design to be nested on the lower fishplate 20, with an internal face of this fishplate hugging the rail on the side of its rolling portion 13. The second lateral fishplate 22 is designed to be nested on the lower fishplate 20, with an internal face of this fishplate hugging the rail 1 on the side of its guiding portion 14. The lateral fishplates are provided to be mounted substantially flush with the platform 2 and the rail 1.

Figure 2:
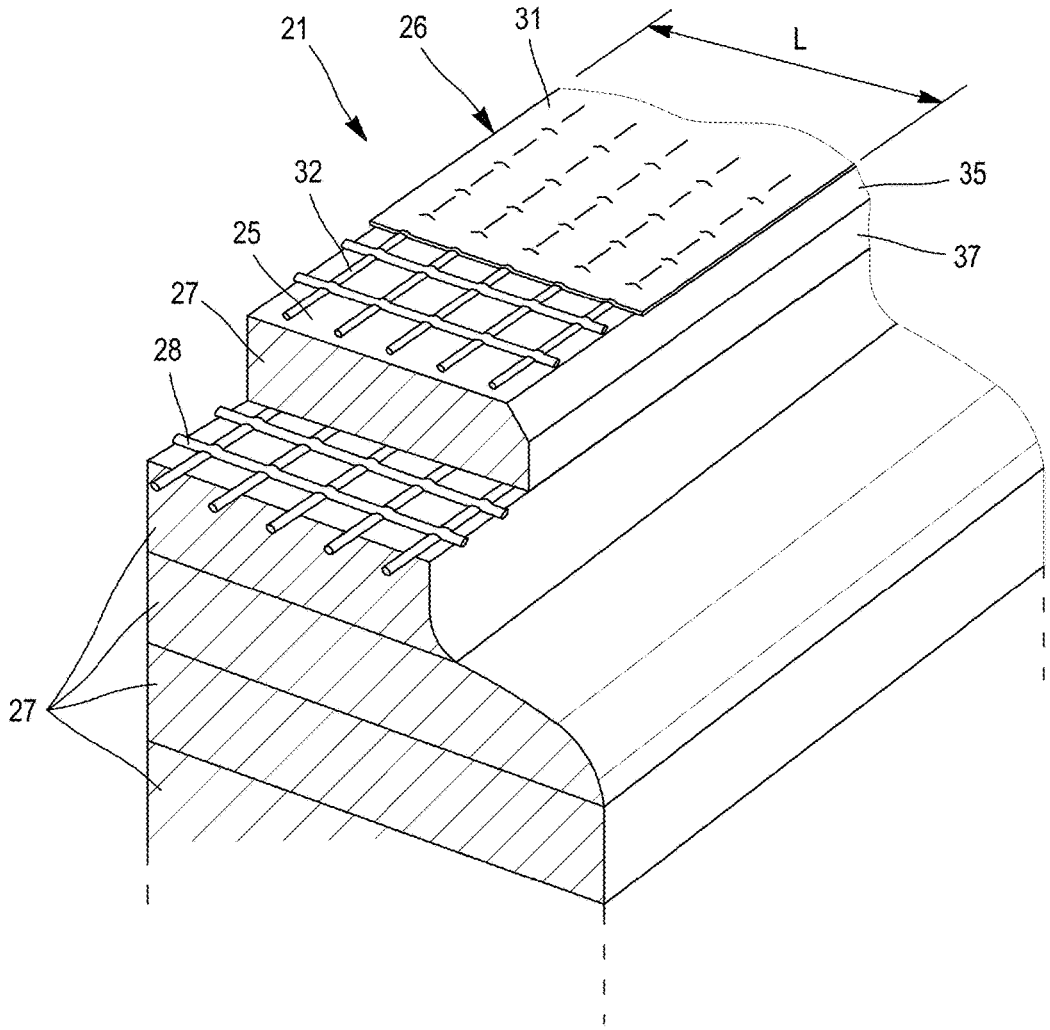
FIG. 2 is a partial view and in perspective of a fishplate according to the invention.

As particularly shown in FIG. 2, each lateral fishplate 21, 22 comprises, on an upper face 25, a protective strip 26. The protective strip is provided to protect the corresponding fishplate from aggressions due to:

the rolling of vehicles, such as automobiles circulating on a lane that crosses the rails;

the stress of weather, such as rain or UV rays.

FIG. 2 shows an upper portion of the first lateral fishplate 21.

In the example shown, the fishplate 21 comprises a stack of layers of matrix 27 and wire meshes 28. A wire mesh 28 is inserted between each pair of neighbouring layers, glued together. This wire mesh is intended to reduce the withdrawal coefficient, in particular longitudinally, of the fishplate.

The protective strip 26 is carried out using a wire mesh 31 and a wire mesh 32 glued together.

The sheet 31 can be, for example, made of polyethylene (PE) or of polyethylene terephthalate (PET). The wire mesh 32 can be, for example, made of polypropylene, polyethylene, glass fibre or polyamide. When the matrix 27 of the fishplate is a plastic foam, for example a polyethylene foam, preferably, the sheet and the wire mesh are chosen in order to be easily welded together and with the matrix 27, in particular the upper face 25 of the upper layer of the matrix 27. More preferably, the wire mesh is arranged in such a way that its warp wires are arranged longitudinally, i.e. substantially parallel to the rail, when the fishplate is in its position of use, and its weft wires are arranged transversally.

The strip 26 is glued on the upper face 25 of the upper matrix layer 27. The strip is cut substantially to the width of the upper face 25 of the upper matrix layer 27. The strip is arranged in such a way that its wire mesh 32 is located between the upper face 25 of the matrix 27 and the sheet 31. The wire mesh makes it possible to reinforce the strip, in such a way that it resists the tangential forces that can be exerted by the rolling of vehicles on the strip.

In the example shown, a chamfer 35 is carried out between the upper face 25 of the fishplate and a lateral face 37 provided to come into contact with the rail 1. As shown in FIG. 1, the chamfer 35 is provided to form, with the rail 1, a groove wherein a seal 36 is poured in order to provide a continuity in the seal between the rail 1 and the protective strip 26. This seal 36 can be, for example, made of polyurethane, bitumen or a synthetic resin.

Of course, the invention is not limited to the examples that have just been described.

As such, other materials can be chosen for the fishplates, the strip and the seal, as long as they are compatible and provide the seal sought. As such, the fishplates can be made from wood or from rubber.

Contrary to what is shown in FIG. 1, a third layer, of asphalt, may be not provided but the second layer, composed of a fine gravel and for example coated with cement, can be flush with the upper face of a respective lateral fishplate.

Also, a lateral fishplate according to the invention may not contain a chamfer, i.e. a seal is not placed between the fishplate and the rail, but a seal deemed as sufficient is carried out by the thrusting of the fishplate against the rail, at the same time as by the sealing strip on the upper face of the fishplate. This arrangement can be chosen according to the operating conditions and, in particular, of the climate of the location where is it located.

A fishplate according to the invention is particularly advantageous, since it makes it possible to carry out a seal and a protection at the same time as the fishplate is installed, without waiting for the end of the work on the carrying out of the railway. As such, the fishplate bearing its own protection, is protected all throughout this work, in particular from the circulation of construction equipment.

The invention claimed is:

1. A lateral fishplate (21, 22) for isolating a railway rail (1), including a buried rail, wherein an upper face of said fishplate comprises a protective strip (26), formed of a wire mesh (32) and of a sheet (31) glued to one another.

2. The fishplate according to claim 1, wherein, said fishplate further comprises a matrix (27), and the wire mesh (32) of the strip (26) is glued on an upper face (25) of the matrix (27) of the fishplate.

3. The fishplate according to claim 2, wherein the material of the matrix is chosen from a polyethylene foam, a polyurethane foam, and a polypropylene foam.

4. The fishplate according to claim 1, wherein the sheet (31) is a sheet made of polyethylene (PE) or polyethylene terephthalate (PET).

5. The fishplate according to claim 4, wherein the wire mesh (32) is constituted of wires made of polypropylene, polyethylene, glass fibre or polyamide.

6. The fishplate according to claim 1, wherein the wire mesh (32) is constituted of wires made of polypropylene, polyethylene, glass fibre or polyamide.

7. The fishplate according to claim 1, wherein the fishplate comprises at least one chamfer (35) between the upper face (26) and a lateral face (37) provided to come into contact with the rail (1).

8. A method for carrying out a seal along a buried rail (1) in a substrate (4), comprising the following steps:

supplying of the lateral fishplate (21, 22) according to claim 1; and setting in place of said fishplate engaged with the rail.

9. The method according to claim 8, further comprising the implementation of a seal along the rail (1) between the strip (26) and said rail (1), in a groove (35, 1) formed by a chamfer (35) of the fishplate (21, 22) and said rail (1).

10. The fishplate according to claim 1, wherein the wire mesh (32) and the sheet (31) are glued to one another by a weld.

11. The fishplate according to claim 10, wherein, the fishplate further comprises a foam matrix (27), a material of the matrix being a polyethylene foam, a polyurethane foam, or a polypropylene foam, and the wire mesh (32) of the strip (26) is attached on an upper face (25) of the matrix (27) via the weld.

12. The fishplate according to claim 11, wherein the matrix (27) comprises a chamfer (35) between the upper face (25) of the matrix (27) and a lateral face (37) of the matrix (27), the chamfer (35) provided to come into contact with the railway rail (1).

13. The fishplate according to claim 12, wherein, the sheet (31) is a sheet made of polyethylene (PE) or polyethylene terephthalate (PET), and the wire mesh (32) is constituted of wires made of polypropylene, polyethylene, glass fibre or polyamide.

14. The fishplate according to claim 13, wherein warp wires of the wire mesh (32) are arranged longitudinally, parallel to a length direction of the fishplate and weft wires of the wire mesh (32) are arranged transversally to the length direction of the fishplate.

15. The fishplate according to claim 1, wherein warp wires of the wire mesh (32) are arranged longitudinally, parallel to a length direction of the fishplate and weft wires of the wire mesh (32) are arranged transversally to the length direction of the fishplate.

16. A lateral fishplate for isolating a railway rail (1), including a buried rail, the fishplate comprising:

an upper face comprised of a first matrix (27) and a second matrix (27) located over the first matrix (27);

a first wire mesh (28) glued against an upper face of the first matrix (27) and against a lower face of the second matrix (27); and a protective strip (26) attached to a upper face (25) of the second matrix (27), wherein the protective strip (26) comprises a second wire mesh (32) having a lower side located against an upper face (25) of the second matrix (27) and an upper side located against a sheet (31), wherein the second wire mesh (32) and the sheet (31) are welded together and against the upper face (25) of the second matrix (27) by a weld, wherein the material of the second matrix is selected from the group consisting of a polyethylene foam, a polyurethane foam, and a polypropylene foam, wherein the second wire mesh (32) is constituted of wires made of polypropylene, polyethylene, glass fibre, or polyamide, and wherein the sheet (31) comprises polyethylene (PE) or polyethylene terephthalate (PET).

17. The fishplate according to claim 16, wherein the second matrix (27) comprises a chamfer (35) between the upper face (25) of the second matrix (27) and a lateral face (37) of the second matrix (27), the chamfer (35) provided to come into contact with the railway rail (1).

18. The fishplate according to claim 17, wherein warp wires of the second wire mesh (32) are arranged longitudinally, parallel to a length direction of the fishplate and weft wires of the second wire mesh (32) are arranged transversally to the length direction of the fishplate.

19. The fishplate according to claim 16, wherein warp wires of the second wire mesh (32) are arranged longitudinally, parallel to a length direction of the fishplate and weft wires of the second wire mesh (32) are arranged transversally to the length direction of the fishplate.

* * * * *